US007325893B2

(12) United States Patent
Katayama

(10) Patent No.: US 7,325,893 B2
(45) Date of Patent: Feb. 5, 2008

(54) INK-JET RECORDING APPARATUS AND INK CARTRIDGE

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 184 days.

(21) Appl. No.: 10/885,806

(22) Filed: Jul. 8, 2004

(65) Prior Publication Data

US 2005/0007401 A1 Jan. 13, 2005

(30) Foreign Application Priority Data

Jul. 9, 2003 (JP) ..... 2003-194654

(51) Int. Cl.
*B41J 2/195* (2006.01)
*B41J 2/175* (2006.01)

(52) U.S. Cl. ..... 347/7; 347/86

(58) Field of Classification Search ..... 347/7, 347/19, 23, 84–86

See application file for complete search history.

(56) References Cited

U.S. PATENT DOCUMENTS 4,419,678 A 12/1983 Kasugayama et al.
5,070,346 A * 12/1991 Mochizuki et al. ..... 347/7
5,255,019 A * 10/1993 Mochizuki et al. ..... 347/7
5,329,304 A 7/1994 Koizumi et al.
6,102,517 A * 8/2000 Kobayashi et al. ..... 347/23
6,286,921 B1 * 9/2001 Ochi et al. ..... 347/7
6,702,427 B2 * 3/2004 Shimizu et al. ..... 347/50
2002/0089555 A1 * 7/2002 Kobayashi et al. ..... 347/7
2002/0118236 A1 * 8/2002 Uetsuki ..... 347/7

FOREIGN PATENT DOCUMENTS

EP 0 509 747 A1 10/1992
EP 0 783 968 A2 7/1997
EP 0 812 693 A1 12/1997
EP 1 048 469 A2 11/2000
EP 1 164 024 A2 12/2001
EP 1 232 869 A1 8/2002
EP 1 232 870 A1 8/2002
EP 1 232 871 A1 8/2002
JP B2 3075286 6/2000
JP A 2002-307711 10/2002

* cited by examiner

*Primary Examiner*—Hai Pham
(74) *Attorney, Agent, or Firm*—Oliff & Berridge, PLC

(57) ABSTRACT

An ink-jet recording apparatus includes a judging unit that judges an ink residual amount of an ink container, a pair of electrodes that are in contact with ink in the ink container and that are spaced apart, a detecting unit that detects an electrical characteristic between the pair of electrodes, a first route that is formed so as to connect the pair of electrodes via the ink in a state that the ink in the ink container is more than a prescribed amount, and a second route that connects the pair of electrodes in a state that the ink in the ink container is of the prescribed amount or less, the second route establishing electrical continuity though it is different from the first route in the electrical characteristic between the pair of electrodes via the ink.

26 Claims, 10 Drawing Sheets

INK-JET RECORDING APPARATUS AND INK CARTRIDGE

BACKGROUND OF THE INVENTION

1. Field of the Invention

The present invention relates to an ink-jet recording apparatus and an ink cartridge. In particular, the invention relates to an ink-jet recording apparatus capable of judging the residual ink amount reliably and outputting an ink empty signal in a state that the residual ink amount is very small and an ink cartridge used in that ink-jet recording apparatus.

2. Description of the Related Art

As disclosed in Japanese Patent No. 3,075,286, an ink-jet recording apparatus is known which judges a residual ink amount of an ink accommodation unit (i.e., ink cartridge). In this ink-jet recording apparatus, two electrodes are provided in the ink cartridge and electrical resistance between the two electrodes is detected. The detected electrical resistance is always compared with a preset value. The ink-jet recording apparatus outputs a warning signal (near-empty signal) if the electrical resistance is higher than the preset value. At the same time as the output of the near-empty signal, the ink-jet recording apparatus outputs, to a number-of-recorded-sheets counting circuit (number-of-sheets counter), an instruction to start counting of the number of recorded sheets. When the count has reached the number of recordable sheets that corresponds to an ink residual amount at the time of the near-empty detection, the ink-jet recording apparatus outputs an alarm signal (ink empty signal) and stops the recording operation.

SUMMARY OF THE INVENTION

However, in the ink-jet recording apparatus that outputs an ink empty signal with the counting of the number of recorded sheets by the number-of-sheets counter after outputting a near-empty signal on the basis of detected electrical resistance between the electrodes, a corresponding relationship between the actually consumed ink amount and the ink amount that is assumed and set on the basis of the number of sheets counted by the number-of-sheets counter is not accurate. Therefore, an ink empty signal needs to be output in a state that a prescribed amount of ink remains, which is not economical, that is, the efficiency of ink utilization is low.

The present invention has been made to solve the above problem, and an object of the invention is to provide an ink-jet recording apparatus capable of judging the residual ink amount reliably and outputting an ink empty signal in a state that the residual ink amount is very small and an ink cartridge used in that ink-jet recording apparatus.

One aspect of the present invention provides an ink-jet recording apparatus including: a pair of electrodes that are in contact with ink in the ink container and that are spaced apart; a detecting unit that detects an electrical characteristic between the pair of electrodes; a first route that is formed so as to connect the pair of electrodes via the ink in a state that the ink in the ink container is more than a first prescribed amount; a second route that connects the pair of electrodes in a state that the ink in the ink container is of the first prescribed amount or less, the second route establishing electrical continuity though it is different from the first route in the electrical characteristic between the pair of electrodes via the ink; and a first judging unit that judges an ink residual amount of the container based on the electrical characteristic detected by the detecting unit.

In this ink-jet recording apparatus, the pair of electrodes are in contact with the ink in the ink container and are spaced apart, and the detecting unit detects an electrical characteristic between the pair of electrodes. The first route connecting the pair of electrodes is formed in a state that the ink in the ink container is more than the first prescribed amount. The second route connecting the pair of electrodes is formed in a state that the ink in the ink container is of the first prescribed amount or less, the second route establishing electrical continuity though it is different from the first route in the electrical characteristic between the pair of electrodes via the ink. The judging unit judges the ink residual amount in accordance with the electrical characteristic detected along the first route or the second route.

Another aspect of the present invention provides an ink-jet recording apparatus including: a judging unit that judges an ink residual amount of an ink container; a pair of electrodes that are in contact with ink in the ink container and that are spaced apart; and a detecting unit that detects an electrical characteristic between the pair of electrodes; wherein the judging unit judges a near-empty state and an ink empty state using the pair of electrodes and the detecting unit.

In this ink-jet recording apparatus, the judging unit judges the near-empty state and the ink empty state using the pair of electrodes and the detecting unit.

Still another aspect of the present invention provides an ink cartridge for storing ink, including: electrode insertion portions through which a pair of electrodes are inserted so as to come into contact with ink in the ink cartridge; a first route that is formed so as to connect, via the ink, the pair of electrodes inserted through the electrode insertion portions in a state that the ink in the ink cartridge is more than a prescribed amount; and a second route that connects the pair of electrodes in a state that the ink in the ink cartridge is of the prescribed amount or less, the second route establishing electrical continuity though it is different from the first route in an electrical characteristic between the pair of electrodes via the ink.

In this ink cartridge, the pair of electrodes are inserted through the electrode insertion portions so as to come in to contact with the ink in the ink cartridge. The first route that connects the pair of electrodes inserted through the electrode insertion portions is formed in a state that the ink in the ink cartridge is more than the prescribed amount. The second route connecting the pair of electrodes is formed in a state that the ink in the ink cartridge is of the prescribed amount or less, the second route establishing electrical continuity though it is different from the first route in an electrical characteristic between the pair of electrodes via the ink. The electrical characteristic of electrical conduction established between the pair of electrodes by the first route is different from that by the second route.

Still another aspect of the present invention provides an ink cartridge for storing ink, including: a pair of electrodes that are disposed so as to be in contact with ink in the ink cartridge; a first route that is formed so as to connect the pair of electrodes via the ink in a state that the ink in the ink cartridge is more than a prescribed amount; and a second route that connects the pair of electrodes in a state that the ink in the ink cartridge is of the prescribed amount or less, the second route establishing electrical continuity though it is different from the first route in an electrical characteristic between the pair of electrodes via the ink.

In this ink cartridge, the pair of electrodes are disposed so as to be in contact with ink in the ink cartridge. The first route that connects the pair of electrodes disposed in the ink cartridge is formed in a state that the ink in the ink cartridge is more than the prescribed amount. The second route that connects the pair of electrodes is formed in a state that the ink in the ink cartridge is of the prescribed amount or less, the second route establishing electrical continuity though it is different from the first route in an electrical characteristic between the pair of electrodes via the ink. The electrical characteristic of electrical conduction established between the pair of electrodes by the first route is different from that by the second route.

BRIEF DESCRIPTION OF THE DRAWINGS

The present invention may be more readily described with reference to the accompanying drawings:

FIGS. 3A and 3B are partial enlarged views of a barrier member and a tube in which FIG. 3A is an enlarged sectional view of the barrier member and the tube and FIG. 3B shows the structure of the barrier member as viewed from direction 3B that is indicated in FIG. 3A;

FIGS. 5A and 5B are sectional views of an ink cartridge according to a second embodiment that is mounted on an ink-jet head in which FIG. 5A is a partial enlarged sectional view and FIG. 5B is a sectional view taken along line 5B-5B in FIG. 5A;

FIGS. 10A and 10B are views of a modified ink cartridge that is mounted on an ink-jet head in which FIG. 10A is a view as viewed from direction 10A that is indicated in FIG. 10B and FIG. 10B is a sectional view.

DETAILED DESCRIPTION OF THE PREFERRED EMBODIMENTS

Figure 1:
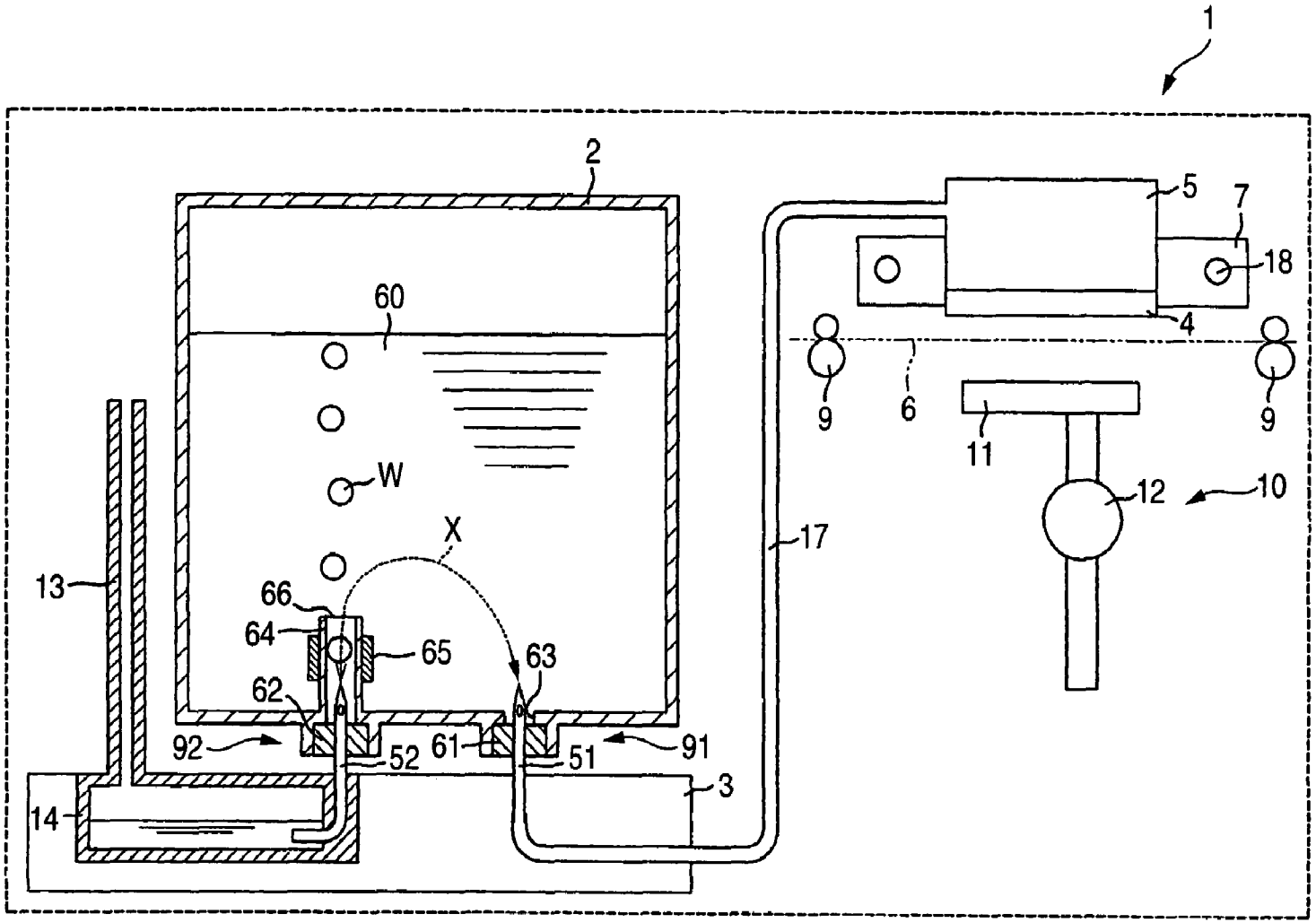
FIG. 1 schematically shows an ink-jet recording apparatus according to the invention.

A first preferable embodiment of the present invention will be hereinafter described with reference to the accompanying drawings. FIG. 1 schematically shows an ink-jet recording apparatus 1 according to the invention.

The ink-jet recording apparatus 1 is mainly composed of a plurality of ink cartridges 2 that are charged with color inks of four colors (cyan, magenta, yellow, and black), respectively, an attaching unit 3 to which the ink cartridges 2 are attached in a detachable manner, buffer tanks 5 for storing inks that are supplied from the ink cartridges 2 via ink supply tubes 17, respectively, a print head 4 for jetting inks stored in the respective buffer tanks 5 toward a printing sheet 6, a carriage 7 that is mounted with the buffer tanks 5 and the print head 4 and is reciprocated linearly, carriage shafts 18 as guides for the reciprocation of the carriage 7, a transport mechanism 9 for transporting the printing sheet 6, and a purge device 10.

The bottom portion of each ink cartridge 2 has two insertion portions 91 and 92 for electrodes, and the insertion portions 91 and 92 are provided with respective plugs 61 and 62 for keeping the inside in a sealed state. The one plug 61 is in contact with ink 60 via an extraction outlet 63 that is formed through the bottom portion of the ink cartridge 2. The other plug 62 is in contact with the ink 60 via a cylindrical barrier member 64 that extends upward from the vicinity of the insertion portion 92 of the bottom portion of the ink cartridge 2 and that has a top opening 66. The side surface of the barrier member 64 is covered with a tube 65 (described later).

A hollow extraction needle 51 for extracting part of the ink 60 stored in the ink cartridge 2 and supplying it to the print head 4 and a hollow air introduction needle 52 for introducing air into the ink cartridge 2 as the extraction needle 51 extracts part of the ink 60 projects approximately parallel with each other from the attaching unit 3. The bottom end of the air introduction needle 52 is in contact with ink in an ink storage room 14 that is provided in the attaching unit 3, and the top portion of the ink storage room 14 communicates with a communication pipe 13 as a passage that communicates with the atmosphere.

When the ink cartridge 2 is attached to the attaching unit 3, the extraction needle 51 sticks through the plug 61 and comes into contact with the ink 60 and the air introduction needle 52 sticks through the plug 62 and comes into contact with the ink 60. The plugs 61 and 62 are made of an elastic material such as butyl rubber. Therefore, the extraction needle 51 and the air introduction needle 52 can stick through the plugs 61 and 62, and the plugs 61 and 62 exhibit elastic action that they keep a sealing state even after the extraction needle 51 and the air introduction needle 52 are removed.

If ink is extracted from the extraction needle 51 as the print head jets ink in a state that the ink cartridge 2 is attached to the attaching unit 3, the pressure in the ink cartridge 2 decreases and air of an amount corresponding to the pressure decrease is introduced into the ink cartridge 2 via the communication pipe 13, the ink storage room 14, and the air introduction needle 52. The top opening of the extraction needle 51 is located at a position that is lower than an outlet 72 of a groove passage 71 (described later) of the barrier member 64 and that is close. to the bottom portion of the ink cartridge 2. This makes it possible to almost use up the ink that is outside the cylindrical barrier member 64. The ink inside the cylindrical barrier member 64 remains in a state that the air introduction needle 52 is immersed therein.

The print head 4 is equipped with a plurality of nozzles, and inks that are stored in the buffer tanks 5 are jetted from those nozzles. In a printing operation, inks are jetted while the carriage 7 is reciprocated, whereby recording is performed on the printing sheet 6. In purge processing, the print head 4 is moved to a purge execution position that is set outside a printing range and inks containing foreign matter are ejected toward a waste ink tank (not shown) that is disposed at the purge execution position.

The purge device 10 is a device that performs purge processing for restoring a good discharge state by sucking high-viscosity inks that may clog the nozzles of the print head 4, air, etc. The purge device 10 is mainly composed of a purge cap 11 that is brought into contact with the jetting surface of the print head 4 and thereby forms a closed space together with the jetting surface in a state that the print head 4 is located at the purge execution position and a suction pump (PG pump) 12 for sucking inks. The purge device 10 is configured so that the purge cap 11 can move in the direction in which it comes into contact with and is separated from the jetting surface.

Figure 2:
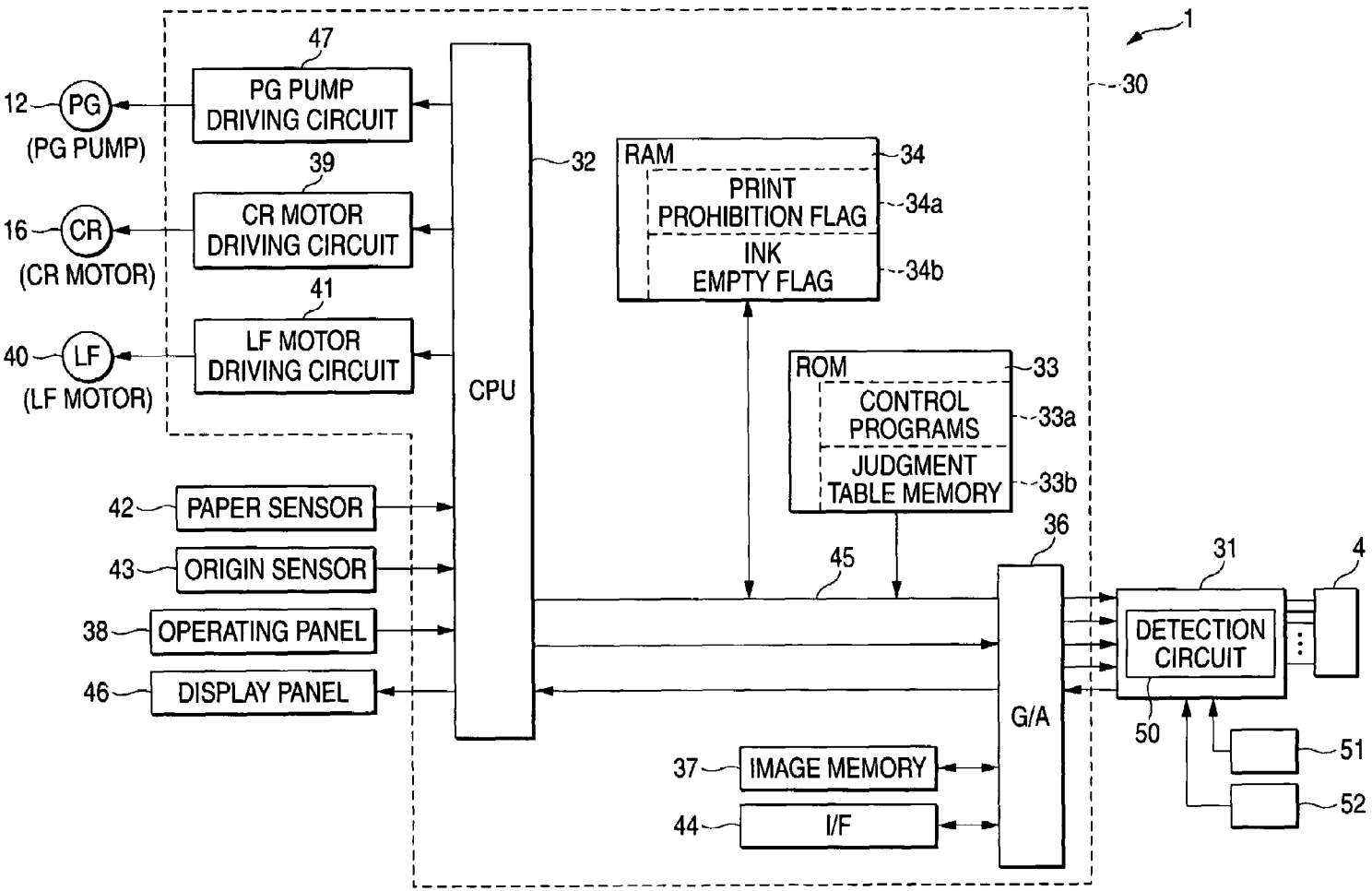
FIG. 2 is a block diagram outlining an electrical circuit configuration of the ink-jet recording apparatus.

FIG. 2 is a block diagram outlining an electrical circuit configuration of the ink-jet recording apparatus 1. A controller for controlling the ink-jet recording apparatus 1 is equipped with a main-body-side control board 30 and a carriage board 31 that is mounted on the carriage 7. The main-body-side control board 30 is mounted with a one-chip microcomputer (CPU) 32, a ROM 33 in which various control programs to be executed by the CPU 32 and fixed value data are stored, a RAM 34 as a memory for storing various data, etc., temporarily, an image memory 37, and a gate array (G/A) 36.

The CPU 32 as a processing unit performs various kinds of processing according to the control programs 33*a* that are stored in the ROM 33 in advance. Further, the CPU 32 generates a print timing signal and a reset signal and sends those signals to the G/A 36 (described later). An operating panel 38 through which a user inputs a print instruction, etc., a display panel 46 for displaying various kinds of information, a CR motor driving circuit 39 for driving a CR motor 16 for reciprocating the carriage 7, an LF motor driving circuit 41 for driving a transport motor (LF motor) 40 that is provided in the transport mechanism 9 and transports the printing sheet 6, a PG pump driving circuit 47 for driving the PG pump 12, a detection circuit 50 for detecting resistance between the extraction needle 51 as a first electrode and the air introduction needle 52 as a second electrode to judge a near-empty state and an ink empty state, a paper sensor 42 for detecting the head of the printing sheet 6, an origin sensor 43 for detecting the origin position of the carriage 7, and other devices are connected to the CPU 32. Operation of each device that is connected to the CPU 32 is controlled by the CPU 32.

The ROM 33 is provided with control programs 33*a* and a judgment table memory 33*b*. The control programs 33*a* are a program of a process for judging for a near-empty state and an ink empty state of the residual amount of ink stored in each ink cartridge 2 and other programs. Data to be used for judging for a near-empty state and an ink empty state of each ink cartridge 2 such as criteria by which to judge for a near-empty state and an ink empty state on the basis of detected resistance between the extraction needle 51 and the air introduction needle 52 that is detected by a detection circuit 50 (described later) are stored in the judgment table memory 33*b*.

The RAM 34, which is a rewritable, volatile memory, is provided with a print prohibition flag 34*a* and ink empty flags 34*b*. The print prohibition flag 34*a* is a flag for prohibiting printing in a state that a judgment result "ink empty" has been produced. When the print prohibition flag 34*a* is turned on, the CPU 32 prohibits a printing operation. The ink empty flags 34*b* are flags indicating whether the ink residual amounts of the ink cartridges 2 are in an ink empty state, respectively, and are turned on or off on the basis of results of comparison between detected resistance values and the above-mentioned ink empty judgment data.

The G/A 36 outputs print data (drive signals) for printing of image data on a printing sheet, a transfer clock that is synchronized with the print data, a latch signal, a parameter signal to be used for generating a fundamental print waveform signal, and a discharge timing signal (output in a prescribed cycle) on the basis of a print timing signal sent from the CPU 32 and the image data stored in the image memory 37, and sends those signals to the carriage board 31 that is mounted with a head driver.

The G/A 36 stores, in the image memory 37, image data that are sent from an external apparatus such as a computer via a centronics interface (I/F) 44. The G/A 36 generates a centronics data reception interrupt signal on the basis of centronics data that are sent from a host computer or the like via the I/F 44, and sends the centronics data reception interrupt signal to the CPU 32. Signals that are exchanged between the G/A 36 and the carriage board 31 are sent via a harness cable connecting those. The ROM 33, the RAM 34, and the G/A 36 are connected to the CPU 32 via a bus line 45.

The carriage board 31 is a board for driving the print head 4 by means of the head driver (i.e., driving circuit) mounted thereon. The print head 4 and the head driver are connected to each other by a flexible wiring board in which copper foil wiring patterns are formed on a polyimide film of 50 to 150 mm in thickness. Controlled via the G/A 36 that is mounted on the main-body-side board 30, the head driver applies, to individual driving elements, drive pulses of waveforms that are suitable for a recording mode. As a result, prescribed amounts of inks are jetted out.

The detection circuit 50 applies voltages to the extraction needle 51 and the air introduction needle 52 as the electrodes and detects resistance between the extraction needle 51 and the air introduction needle 52. An output based on the detected resistance is sent to the CPU 32 and compared with the table that is stored in the ROM 33 and correlates the output based on the resistance with the ink residual amount.

Figure 3A:
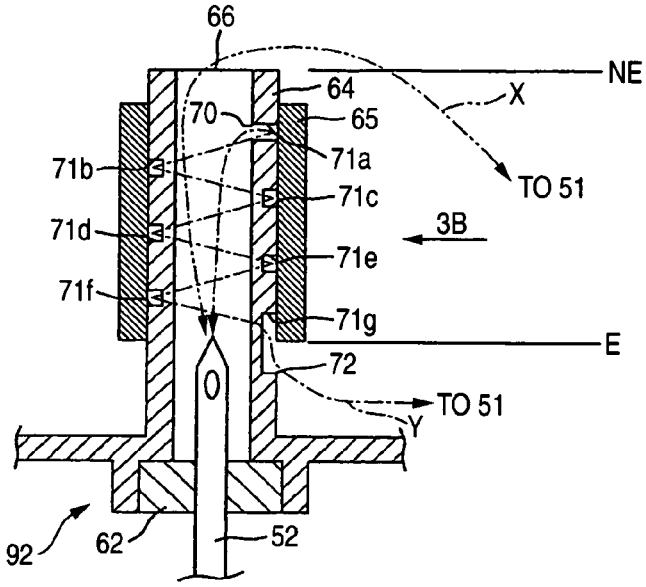
Figure 3B:
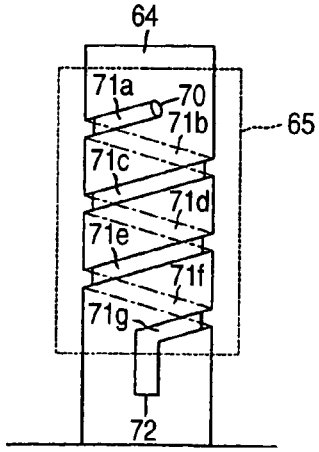

The barrier member 64 and the tube 65 that covers the side surface of the barrier member 64 will now be described in detail with reference to FIGS. 3A and 3B. FIGS. 3A and 3B are partial enlarged views of the barrier member 64 and the tube 65. FIG. 3A is an enlarged sectional view of the barrier member 64 and the 65 tube and FIG. 3B shows the structure of the barrier member 64 as viewed from direction 3B that is indicated in FIG. 3A.

As shown in FIG. 3A, the barrier member 64 is formed, at a position close to the top of the barrier member 64, with a communication hole 70 that allows the inside and the outside of the barrier member 64 to communicate with each other. The communication hole 70 communicates with a groove passage 71 that consists of grooves 71*a*-71*g* formed in the side surface of the barrier member 64. As shown in FIG. 3B, the groove passage 71 is formed spirally from the position close to the top of the barrier member 64 to a position close to its bottom. An outlet 72 is formed at the bottom end of the groove passage 71.

The side surface of the barrier member 64 is covered with the tube 65 that exhibits elastic action, whereby the groove passage 71 takes the form of a hollow passage. Ink 60 flows through the hollow groove passage 71. Part of the outlet 72 is not covered with the tube 65, and hence the inside and the outside of the barrier member 64 communicate with each other via the communication hole 70, the groove passage 71, and the outlet 72. The groove passage 71 that is covered with the tube 65 has such a cross-section as to be able to hold ink by the capillary action.

Electrical conduction between the extraction needle 51 and the air introduction needle 52 is effected by means of the ink 60 along two routes, that is, a conduction route X that passes the top end of the barrier member 64 (see FIG. 1) and a conduction route Y that includes the communication passage consisting of the communication hole 70, the groove passage 71, and the outlet 72. Including the spiral groove, the conduction route Y is narrower and longer than the conduction route X.

In a state that the ink 60 stored in the ink cartridge 2 is greater in height than the barrier member 64, both conduction routes X and Y are conductive. However, since the conductive route X is larger in cross-section and shorter in length than the conduction route Y, most of the current flows along the conduction route X and hence the detected resistance between the electrodes should be low. In the first embodiment, the resistance between the electrodes amounts to about 50 kΩ in a state that the conductive route X is conductive (see FIG. 4).

On the other hand, when the ink 60 has been consumed and its top level of the ink 60 has become lower than the opening 66, the conduction route X is rendered non-conductive and the conductive route Y remains conductive. Since the conduction route Y is smaller in cross-section and greater in length, the detected resistance between the electrodes becomes high. In the first embodiment, the resistance is equal to about 500 kΩ in a state that only the conduction route Y is conductive (see FIG. 4). When the ink 60 has further been consumed and the top level of the ink 60 has become lower than the outlet 72, the conduction route Y also becomes non-conductive, whereby electrical continuity between the electrodes is lost and the resistance becomes infinite. In this manner, the detected resistance between the electrodes varies to a large extent depending on the route(s) that is conductive.

Figure 4:
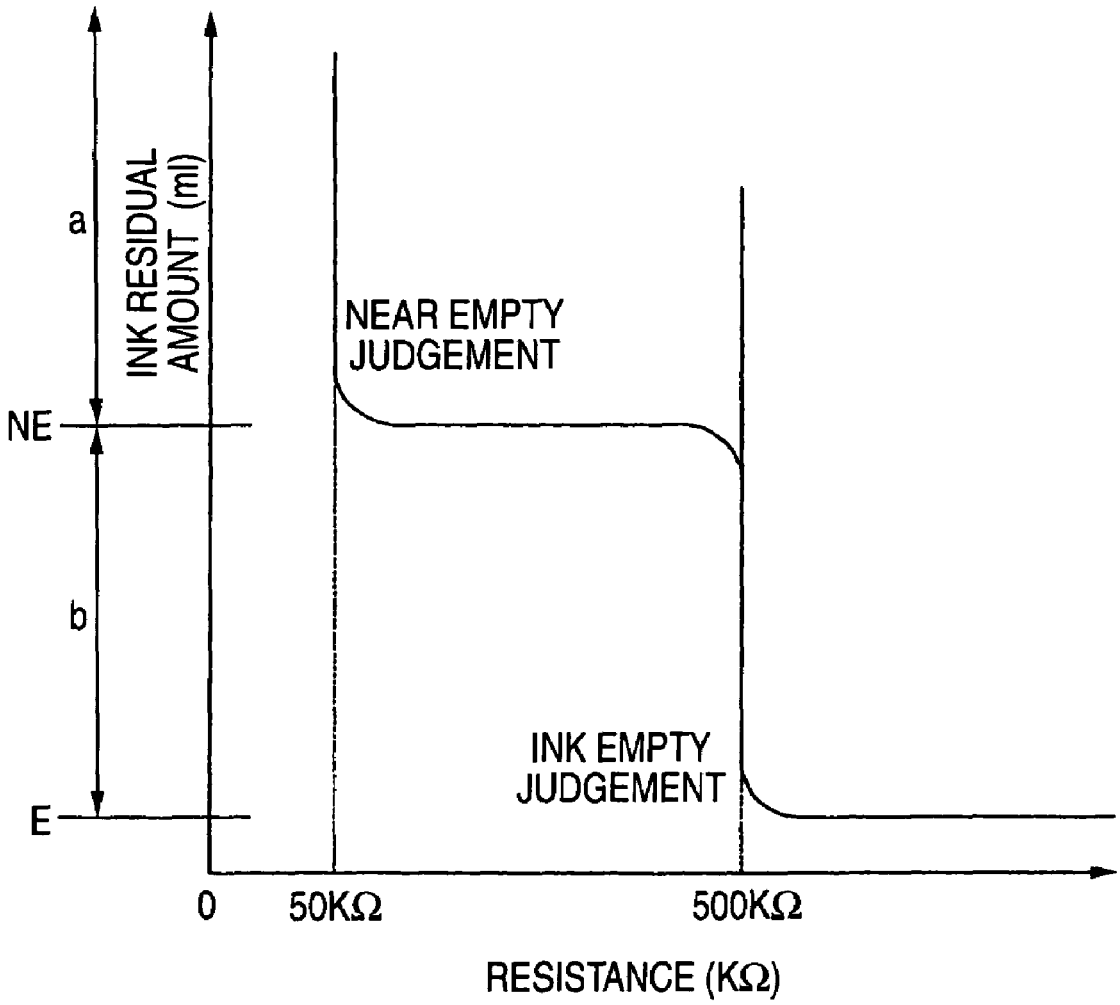
FIG. 4 is a graph showing an exemplary relationship between the ink residual amount and the resistance between the electrodes.

FIG. 4 is a graph showing a relationship between the ink residual amount and the resistance between the electrodes in which the horizontal axis represents the resistance in kΩ and the vertical axis represents the ink residual amount in milliliter (hereinafter abbreviated as ml).

When a judgment process is started by the control programs 33*a*, resistance between the extraction needle 51 and the air introduction needle 52 as the electrodes that is detected by the detection circuit 50 is compared with the data stored in the judgment table memory 33*b*. If the resistance is lower than 50 kΩ, which means that the top surface of the ink 60 stored in the ink cartridge 2 is sufficiently higher than the top opening 66 of the barrier member 64 (range a in FIG. 4), the programs 33*a* return to the main process and printing is enabled. In this state, electrical continuity between the electrodes is established mainly by the conduction route X and hence the resistance is very low.

When the top surface of the ink 60 passes the level approximately corresponding to the top opening 66 of the barrier member 64 (indicated by symbol NE in FIG. 4) as the ink 60 is consumed, the route that mainly establishes electrical continuity between the electrodes is switched from the route X to the route Y and the resistance is sharply switched from a value that is smaller than 50 kΩ to about 500 kΩ. Judging that the resistance is higher than or equal to 50 kΩ and lower than or equal to 500 kΩ, the CPU 32 makes a near-empty display on the display panel 46 and also causes an external apparatus such as a computer to make a near-empty output to inform the user that the ink residual amount is small. Then, the programs 33*a* return to the main process and printing is enabled.

The state that the resistance is approximately equal to 500 kΩ continues until the top surface of the ink 60 outside the barrier member 64 reaches the level of the outlet 72 of the groove passage 71 (range b in FIG. 4). Although the top surfaces of the ink 60 inside and outside the cylindrical barrier member 64 are different, the groove passage 71 holds the ink by the capillary action and the conduction route Y is kept conductive.

If it is judged that the resistance has become higher than 500 kΩ as the ink 60 is consumed further, it means that the top surface of the ink 60 is lower than the level of the outlet 72 of the groove passage 71 (indicated by symbol E in FIG. 4) and electrical continuity between the electrodes is lost. The CPU 32 turns on the ink empty flag 34*b* and causes the display panel 46 to make a display for announcing that the ink 60 has been used up. Further, the CPU 32 turns on the print prohibition flag 34*a* to prohibit printing and causes the external apparatus such as a computer to make a corresponding output. Then, the CPU 32 returns to the main process.

As described above, the ink residual amount of each ink cartridge 2 can be judged on the basis of a variation in the resistance between the extraction needle 51 and the air introduction needle 52 as the electrodes and the resistance between the electrodes varies to a large extent because of the differences (in length etc.) between the conduction routes X and Y. This makes it possible to reliably judge for ink residual amounts corresponding to a near-empty state and an ink empty state.

Figure 5A:
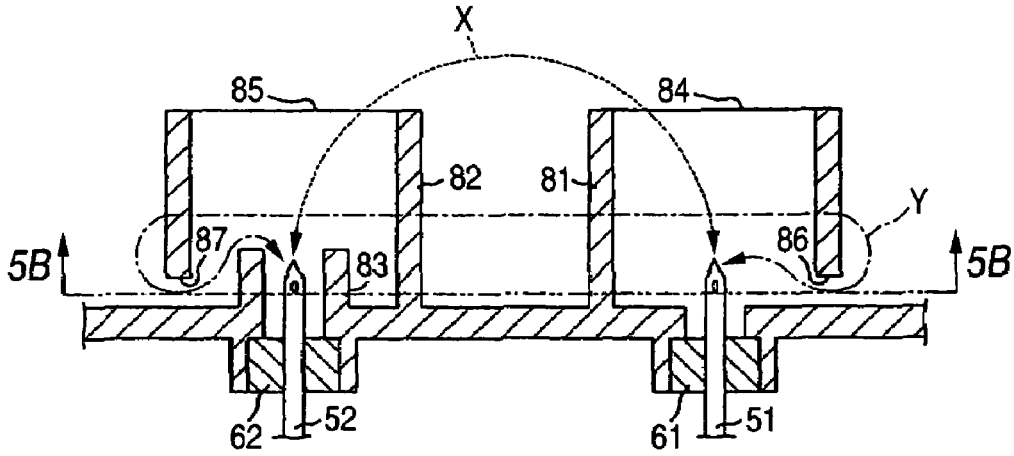
Figure 5B:
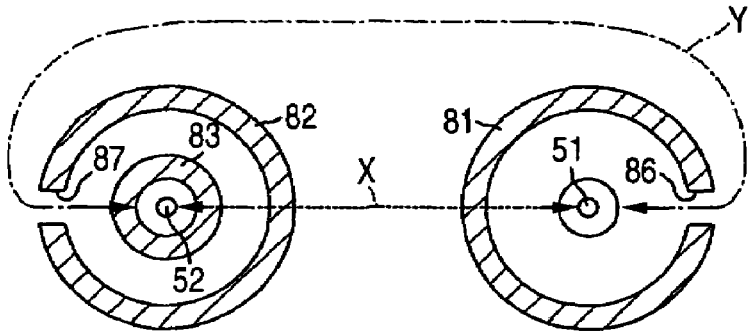

Next, a second embodiment will be described with reference to FIGS. 5A and 5B. FIGS. 5A and 5B are sectional views of an ink cartridge 2 according to the second embodiment that is attached to the ink-jet head 4 in which FIG. 5A is a partial enlarged sectional view and FIG. 5B is an enlarged sectional view taken along line 5B-5B in FIG. 5A. Components having the same components in the first embodiment are given the same reference symbols as the latter and will not be described.

In the ink cartridge 2 according to the second embodiment, the extraction needle 51 is surrounded by a cylindrical first barrier member 81 having a top opening 84 and the air introduction needle 52 is surrounded by a cylindrical second barrier member 82 having a top opening 85. The side walls of the barrier members 81 and 82 are formed with respective communication holes 86 and 87 at positions that are close to the bottom portion of the ink cartridge 2 and are approximately located on the horizontal line connecting the extraction needle 51 and the air introduction needle 52 (on the opposite sides).

A cylindrical member 83 is formed between the second barrier member 82 and the air introduction needle 52 so as to surround the air introduction needle 52. The top level of the cylindrical member 83 is higher than the communication hole 87 and lower than the top face of the second barrier member 82.

The first barrier member 81, the second barrier member 82, and the cylindrical member 83 are connected to the bottom portion of the ink cartridge 2. The top opening of the extraction needle 51 is lower than the top opening of the cylindrical member 83.

Electrical continuity between the extraction needle 51 and the air introduction needle 52 is mainly established by a conduction route X that goes over the top ends of the barrier members 81 and 82 when a large amount of ink 60 is stored, and is established by a conduction route Y that goes outside the side surfaces of the barrier members 81 and 82 and passes the communication holes 86 and 87 when the top surface of the ink 60 is lower than the top faces of the barrier members 81 and 82. The conduction route Y is formed so as to be sufficiently longer than the conduction route X. When the ink 60 has further been consumed and the top surface of the ink 60 has become lower than the top opening of the cylindrical member 83, electrical continuity between the electrodes is lost. Since the two routes for establishing electrical continuity between the electrodes are formed so as to have much different resistance values, ink residual amounts corresponding to a near-empty state and an ink empty state can be detected correctly as in the case of the first embodiment.

Figure 6:
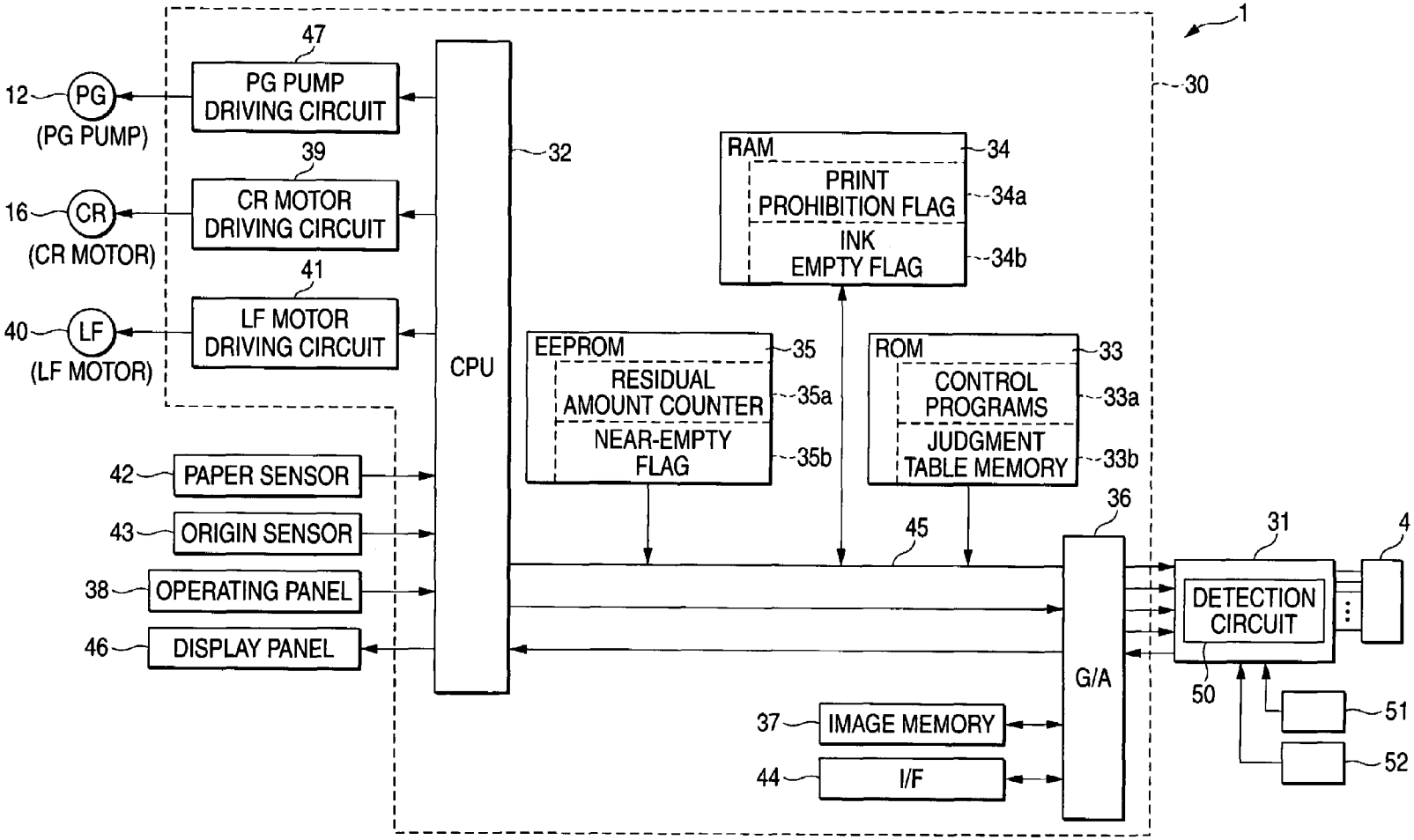
FIG. 6 is a block diagram showing an electrical circuit configuration of a third embodiment.
Figure 7:
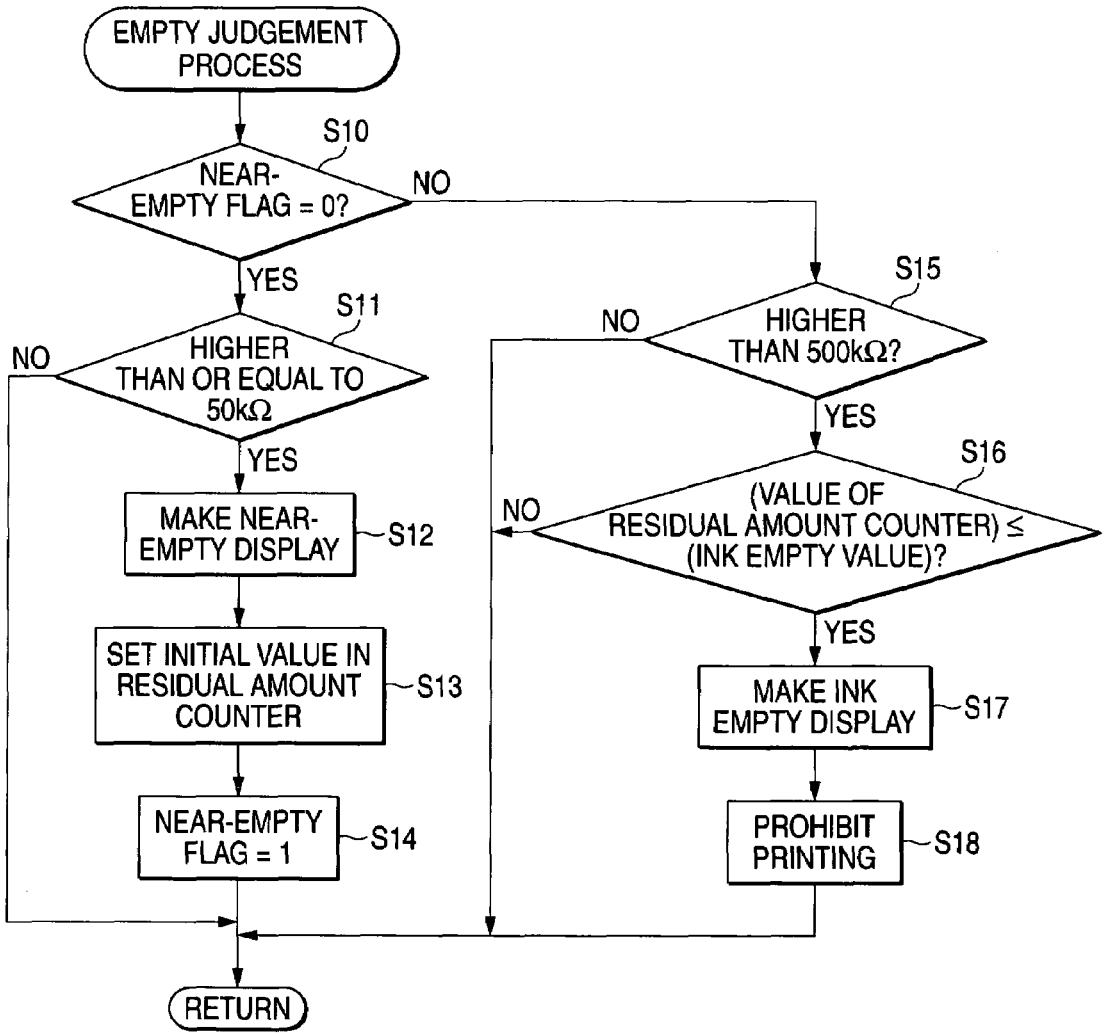
FIG. 7 is a flowchart of a judgment process that is executed in the third embodiment.

FIGS. 6 and 7 show a third embodiment in which software processing is added to the first embodiment to detect the ink residual amount after detection of a near-empty state. Components in FIG. 6 having the same components in FIG. 2 are given the same reference symbols as the latter and will not be described.

In this embodiment, an EEPROM 35 which is a rewritable, nonvolatile memory is provided additionally. The EEPROM 35 has a residual amount counter 35*a* and a near-empty flag 35*b*. The residual amount counter 35*a* sequentially obtains the sum of the amount of ink that is jetted from the nozzles of the print head 4 and the amount of ink that is ejected by purge processing. The ink residual amount is judged by sequentially subtracting the obtained value (i.e., ink consumption amount) from a near-empty-level ink amount in the ink cartridge 2. The near-empty flag 35*b* is a flag for storage of the fact that the ink residual amount is at a value corresponding to the near-empty level. The values of the residual amount counter 35*a* and the near-empty flag 35*b* are reset to initial values when a new ink cartridge is attached.

When a judgment process of FIG. 7 is started, first, the value of the near-empty flag 35*b* is judged. If the value of the near-empty flag 35*b* is equal to "0," that is, if the ink residual amount at the previous judgment process is not smaller than or equal to the value corresponding to the near-empty level (S10: yes), the resistance between the extraction needle 51 and the air introduction needle 52 is judged as in the case of the first embodiment. If the resistance is lower than 50 kΩ (S11: no), which means that the top surface of the ink 60 is sufficiently higher than the top opening 66 of the barrier member 64, the programs 33*a* return to the main process.

If the resistance is higher than or equal to 50 kΩ (S11: yes), a near-empty display is made as in the case of the first embodiment (S12). In this case, the initial value, that is, the ink amount corresponding to the near-empty level, is set in the residual amount counter 35*a* (S13) and processing of subtracting the ink consumption amount from the near-empty-level ink amount is started. Then, the near-empty flag 35*b* is set to "1" (S14) and a return is made to the main process.

If the value of the near-empty flag 35*b* is "1" immediately after the start of the judgment process of FIG. 7 (S10: no), it means that the ink residual amount has already smaller than the value corresponding to the near-empty level. In this case, if the resistance is still between 50 kΩ and 500 kΩ, a return is made to the main process and printing can be continued. If the resistance is higher than 500 kΩ (S15: yes), the value of the counter 35*a* is compared with a preset ink empty value. If the value of the counter 35*a* is smaller than or equal to the preset ink empty value (S16: yes), an ink empty display is made as in the case of the first embodiment (S17) and printing is prohibited (S18).

The reason for performing the judgment using the resistance and the judgment using the residual amount counter 35*a* is to prevent a phenomenon that if the groove passage 71 is closed by bubbles or the like occurring in ink, the resistance of the conduction route Y becomes infinite and printing is stopped immediately after a judgment result "near-empty" is produced.

More specifically, the ink empty value to be compared with the ink residual amount indicated by the residual amount counter 35*a* is set at an ink amount corresponding to the level (indicated by symbol E in FIG. 4) of the resistance value 500 kΩ or a level slightly higher than the level E (a level slightly higher than the level E is preferable because the accuracy of the counter 35*a* is low as described in the prior art section). With this measure, if the resistance has exceeded 500 kΩ (S15: yes) but the value of the counter 35*a* has not reached the ink empty value (S16: no), it is judged that ink still remains and the resistance of the conduction route Y is abnormal. A return is made to the main process and printing is continued.

If the resistance of the conduction route Y exceeds 500 kΩ normally (S15: yes), even if the ink residual amount indicated by the counter 35*a* has already reached the above-mentioned value, an ink empty display can be made correctly and printing can be prohibited when the top surface of the ink 60 reaches the level E shown in FIG. 4.

The invention has been described above in the form of the embodiments. However, the invention is not limited to the embodiments and it is easily understood that various improvements and modifications are possible without departing from the spirit and scope of the invention.

Figure 8:
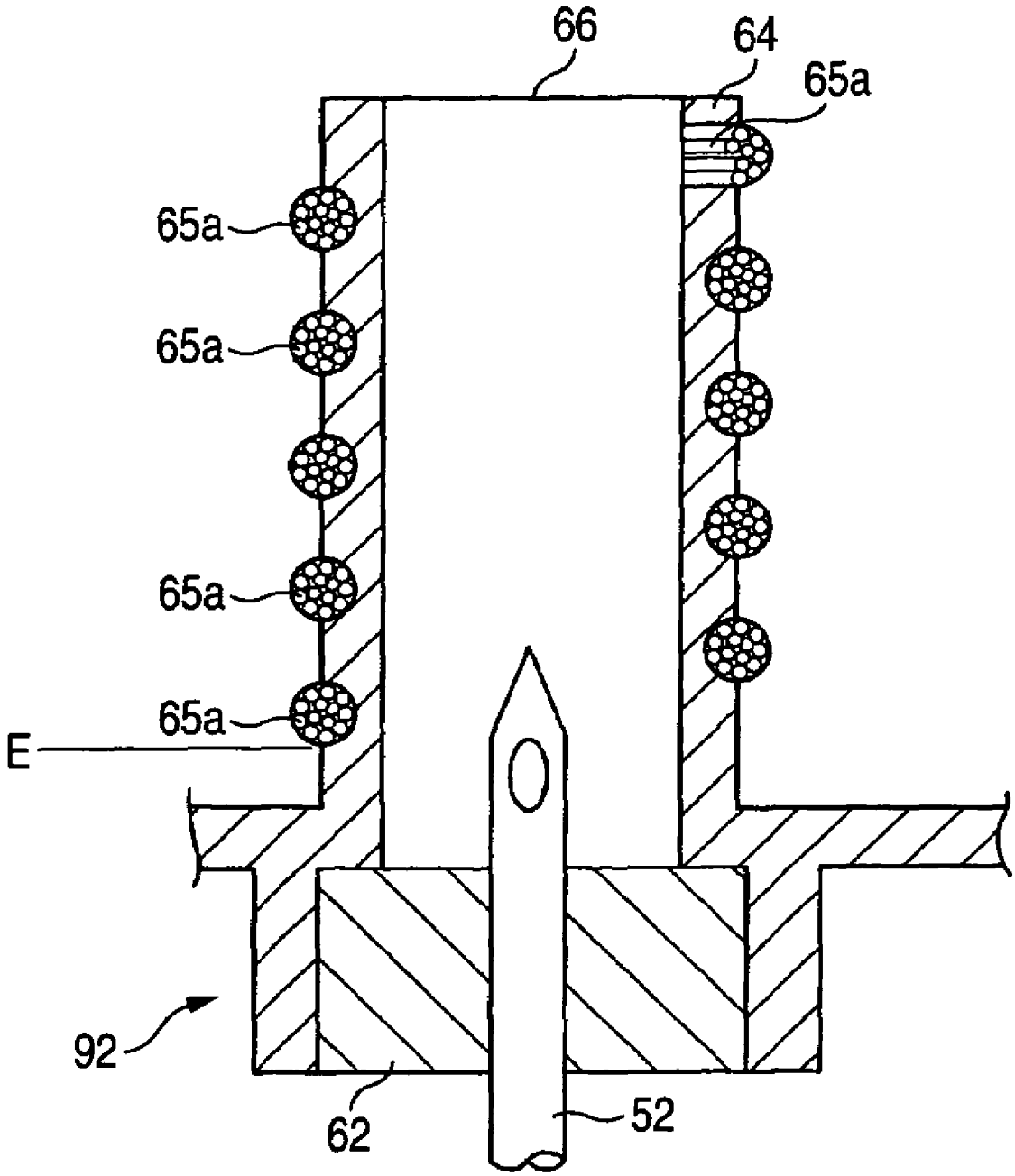
FIG. 8 shows one modified example of a barrier member and a tube.
Figure 9:
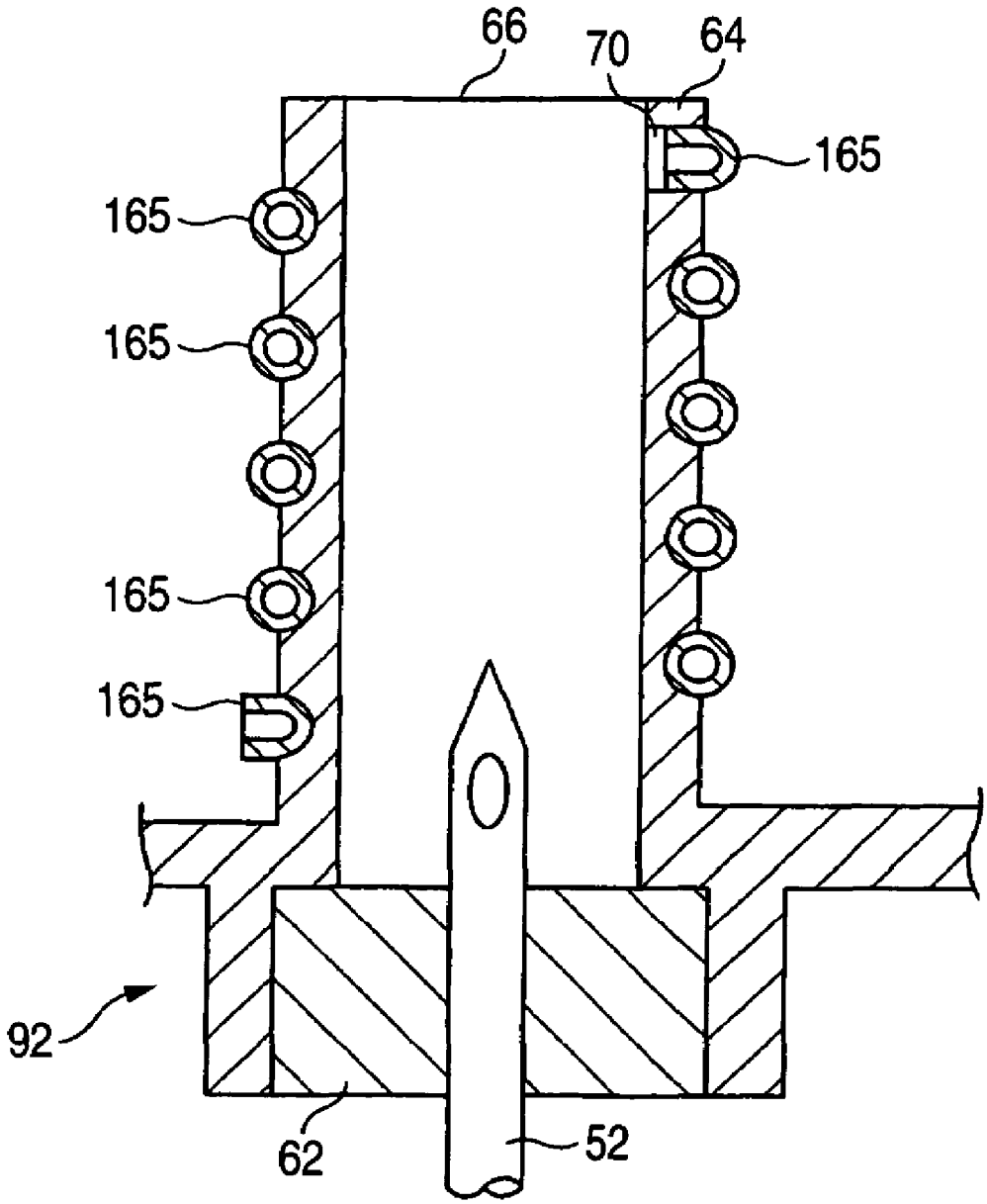
FIG. 9 shows another modified example of a barrier member and a tube.

For example, in the first and third embodiments, a fiber member 65*a* made of an ink-permeable fiber may be provided in the groove passage 71 to prevent clogging of the groove passage 71 with ink or the like as shown in FIG. 8.

In the first and third embodiments, the passage is formed by covering the groove passage 71 with the tube 65 to allow the inside and the outside of the barrier member 64 to communicate with each other. Alternatively, this may be attained by attaching a cylindrical tube 165 to the communication hole 70. In this case, the tube 165 may be wound spirally on the side surface of the barrier member 64 so as to extend over a long distance.

In the above embodiments, the extraction needle 51 and the air introduction needle 52 enter the ink cartridge 2 when each ink cartridge 2 is attached. Alternatively, each ink cartridge 2 may be such as to be provided with a pair of electrodes in advance.

In the second embodiment, the two conduction routes are formed between the electrodes in such a manner that the extraction needle 51 and the air introduction needle 52 are surrounded by the first barrier member 81 and the second barrier member 82, respectively. Alternatively, two conduction routes may be formed by surrounding one of the extraction needle 51 and the air introduction needle 52 with a cylindrical member.

In the above embodiments, configurations, in which the residual ink amount in the ink cartridge that is detachably attached to the ink-jet recording apparatus is detected, are described. The present invention is not limited to such configurations and is applicable to a configuration in which a residual ink amount in an ink tank fixedly disposed on the apparatus instead of the ink cartridge or fixedly disposed on the downstream side of the ink cartridge is detected.

In each of the above embodiment, the barrier member(s) has a cylindrical shape. Alternatively, a flat wall or the like may be provided between the extraction needle 51 and the air introduction needle 52 so as to be connected to a side wall of the ink cartridge 2. In this case, sufficient resistance can be secured by snaking the groove-like passage 71 in the surface of the flat wall.

Figure 10A:
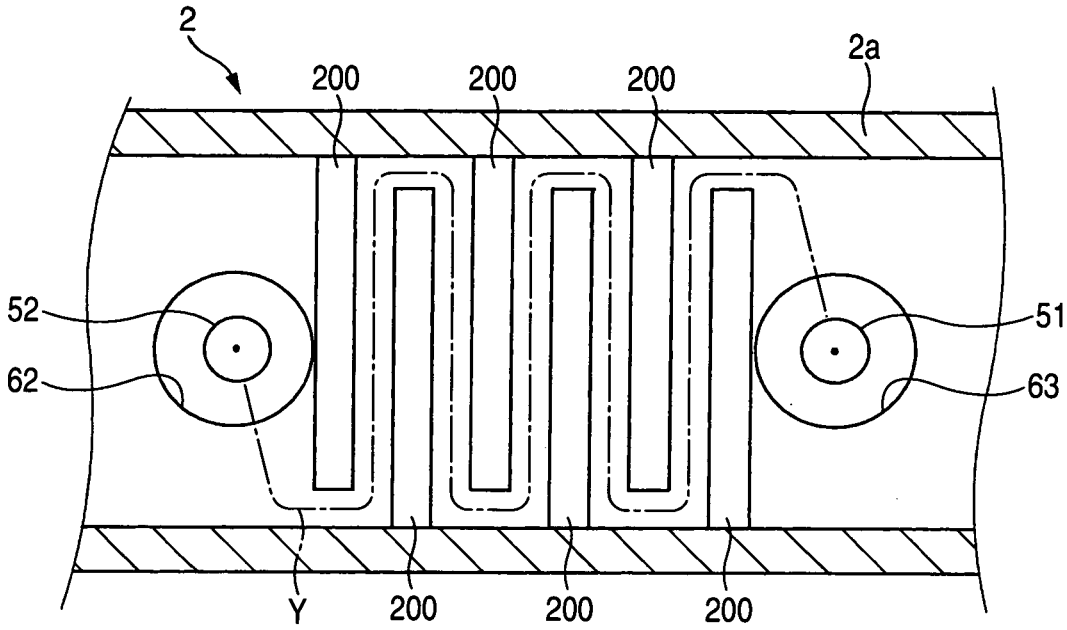
Figure 10B:
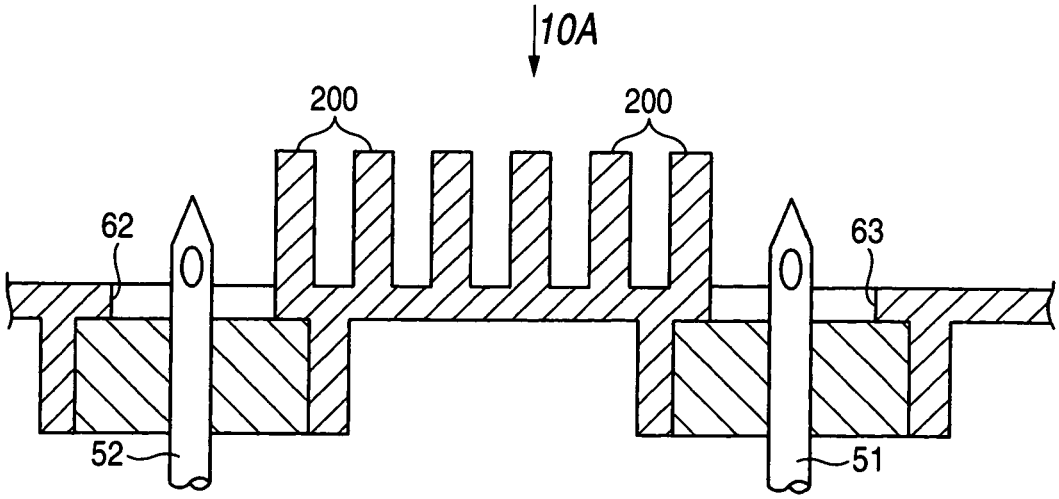

FIGS. 10A and 10B are views of a modified ink cartridge 2. FIG. 10A is a view as viewed from direction 10A that is indicated in FIG. 10B and FIG. 10B is a sectional view.

In this example, a plurality of barrier members 200 having the form of flat walls erects from the bottom portion of the ink cartridge 2. The plurality of barrier members 200 are arranged substantially in parallel to each other between the pair of electrodes 51, 52 in such a manner that the second route Y extends between each two of the barrier members 200 that are adjacent to each other. In the ink-jet recording apparatus according to each of the embodiments, a route connecting a pair of electrodes 51, 52 that are in contact with the ink in an ink cartridge 2 and are spaced apart is formed in the following manner. A first route X connecting the pair of electrodes 51, 52 is formed in a state that the ink in the ink cartridge is of more than a prescribed amount. A second route Y is formed in a state that the ink in the ink cartridge 2 is of the prescribed amount or less, the second route Y establishing electrical continuity though it is different from the first route X in the electrical characteristic between the pair of electrodes 51, 52 via the ink. A detecting unit detects the electrical characteristic of the first route X or the second route Y. The ink residual amount is judged in accordance with the detected electrical characteristic. Different electrical characteristics are detected by the detecting unit when electrical continuity is established by the first route X, when electrical continuity is established by the second route Y, and when electrical continuity is not established by either the first route X or the second route Y. This provides an advantage that the judging unit can reliably judge for three stages of ink residual amounts. The first route X and the second route Y may be formed so that the three stages of ink residual amounts correspond to a state that a large amount of ink exists, a state that the ink is in a near-empty state, and a state that the ink is in an ink empty state. This provides an advantage that a near-empty state and an ink empty state can be detected correctly by judging an ink residual amount in each state reliably.

In addition, the ink-jet recording apparatus provides the following advantages. In this ink-jet recording apparatus, the electrical characteristic between the pair of electrodes 51, 52 via ink that exists along the second route Y is further different when the ink in the ink cartridge is of a second prescribed amount or less, the second prescribed amount being smaller than the prescribed amount. This makes it possible to more reliably judge for three stages of ink residual amounts that correspond to a state that the ink is more than the prescribed amount, a state that the ink is of the prescribed amount or less and more than the second prescribed, and a state that the ink is of the second prescribed amount or less. The first route X and the second route Y may be formed so that the three stages of ink residual amounts correspond to a state that a large amount of ink exists, a state that the ink is in a near-empty state, and a state that the ink is in an ink empty state. This makes it possible to detect a near-empty state and an ink empty state more correctly by judging an ink residual amount in each state more reliably.

Further, the ink-jet recording apparatus provides the following advantage. In this ink-jet recording apparatus, the second route Y is longer than the first route. The electrical characteristic detected by the detecting unit varies depending on the length of the route that establishes electrical continuity between the electrodes 51, 52. Therefore, the difference between detected electrical characteristics can be increased and hence the ink residual amount can be judged more reliably.

Furthermore, the ink-jet recording apparatus provides the following advantage. A barrier 64 is further provided that erects from a bottom portion of the ink cartridge and is disposed between the pair of electrodes 51, 52. The first route X is formed so as to go over the top end of the barrier 64 in the state that the ink is more than the prescribed amount, and the pair of electrodes 51, 52 are connected to each other by the second route Y at least part of which extends along the barrier 64 in the state that the ink is of the prescribed amount or less. When the amount of ink has decreased and its top surface has become lower than the top end of the barrier 64, the first route X is disconnected reliably and the second route Y remains as a route that establishes electrical continuity between the electrodes 51, 52. Therefore, the detecting unit can detect different electrical characteristics reliably and hence the ink residual amount can be judged reliably.

Additionally, the ink-jet recording apparatus according to the first or third embodiment provides the following advantage. The barrier 64 surrounds one of the pair of electrodes 51, 52 and takes the form of a cylinder having a top opening 66. Since one electrode is surrounded by the cylindrical barrier 64, the inside and the outside of the cylindrical barrier 64 are reliably isolated from each other when the amount of ink has decreased and its top surface has become lower than the top end of the cylindrical barrier 64. Therefore, the detecting unit can detect different electrical characteristics reliably and hence the ink residual amount can be judged more reliably.

Furthermore, the ink-jet recording apparatus according to the first or third embodiment provides the following advantages. The part of the second route Y is defined by a groove 71 that is formed in the side surface of the barrier 64 and a cover member 65 that covers an opening of the groove 71 and the groove 71 has, at one end thereof, an opening that is located on the side of one of the pair of electrodes and has, at the other end thereof, an opening that is located on the side of the other electrode. Since ink flows through the groove 71, electrical continuity between the electrodes 51, 52 can be established reliably. Further, since part of the second route Y can be formed by covering the groove 71 in the side surface of the barrier 64 with the cover member 65, the long second route Y can be formed easily and the difference between electrical characteristics detected by a detecting circuit 50 can be increased.

The ink-jet recording apparatus according to the second embodiment provides the following advantage. The barrier 84, 85 has an opening 86, 87 at a position that is distant, approximately in a horizontal direction, from the line segment connecting the pair of electrodes 51, 52, and a curved line existing approximately in a horizontal plane and connecting the pair of electrodes 51, 52 past the opening 86, 87 is longer than the first route that goes over the top end of the barrier 84, 85. Since the first route X and the second route Y are different from each other in length, their electrical characteristics detected by the detecting unit are also different. This makes it possible to judge the ink residual amount reliably.

The ink-jet recording apparatus according to each of the embodiments provides the following advantage. The barrier surrounds at least one of the pair of electrodes 51, 52 and takes the form of a cylinder having a top opening. Since at least one electrode is surrounded by the cylindrical barrier, the inside and the outside of the cylindrical barrier are reliably isolated from each other when the amount of ink has decreased and its top surface has become lower than the top end of the cylindrical barrier. Therefore, the detecting unit can detect different electrical characteristics reliably and hence the ink residual amount can be judged more reliably.

The ink-jet recording apparatus according to the third embodiment provides the following advantage. The second judging unit sequentially obtains an ink consumption amount. The second judging unit judges the ink residual amount on the basis of the obtained ink consumption amount. The controller performs a display operation if the electrical characteristic detected by the detecting unit corresponds to the second prescribed amount and the second judging unit judges that the residual ink amount is approximately equal to the second prescribed amount. Therefore, even if an abnormal value is detected by the detecting unit, the second judging means can judge whether the residual ink amount has reached the second prescribed amount. Further, since the controller performs a display operation, a user can be informed reliably of the residual ink amount that has reached the second prescribed amount.

In the ink cartridge 2 in the each of the embodiments, a first route X that connects a pair of electrodes 51, 52 inserted through electrode insertion portions 91, 92 so as to come into contact with the ink in an ink cartridge is formed in a state that the ink in the ink cartridge 2 is more than a prescribed amount. A second route that connects the pair of electrodes 51, 52 is formed in a state that the ink in the ink cartridge is of the prescribed amount or less, the second route establishing electrical continuity though it is different from the first route in an electrical characteristic between the pair of electrodes 51, 52 via the ink. Different electrical characteristics occur between the pair of electrodes 51, 52 when electrical continuity is established by the first route X, when electrical continuity is established by the second route Y, and when electrical continuity is not established by either the first route X or the second route Y. This provides an advantage that it is possible to reliably judge for three stages of ink residual amounts. The first route X and the second route Y may be formed so that the three stages of ink residual amounts correspond to a state that a large amount of ink exists, a state that the ink is in a near-empty state, and a state that the ink is in an ink empty state. This provides an advantage that a near-empty state and an ink empty state can be detected correctly by judging an ink residual amount in each state reliably.

In the ink cartridge 2 according to each of the embodiments, a first route X that connects a pair of electrodes 51, 52 disposed so as to be in contact with the ink in an ink cartridge 2 is formed in a state that the ink in the ink cartridge is more than a prescribed amount. A second route Y that connects the pair of electrodes 51, 52 is formed in a state that the ink in the ink cartridge 2 is of the prescribed amount or less, the second route establishing electrical continuity though it is different from the first route in an electrical characteristic between the pair of electrodes via the ink. Different electrical characteristics occur between the pair of electrodes 51, 52 when electrical continuity is established by the first route X, when electrical continuity is established by the second route Y, and when electrical continuity is not established by either the first route or the second route. This provides an advantage that it is possible to reliably judge for three stages of ink residual amounts. The first route and the second route may be formed so that the three stages of ink residual amounts correspond to a state that a large amount of ink exists, a state that the ink is in a near-empty state, and a state that the ink is in an ink empty state. This provides an advantage that a near-empty state and an ink empty state can be detected correctly by judging an ink residual amount in each state reliably.

The ink cartridge provides the following advantages. In this ink cartridge 2, the second route Y is further different in the electrical characteristic between the pair of electrodes 51, 52 in a state that the ink in the ink cartridge is of a second prescribed amount or less, the second prescribed amount being smaller than the prescribed amount. This makes it possible to more reliably judge for three stages of ink residual amounts that correspond to a state that the ink is more than the prescribed amount, a state that the ink is of the prescribed amount or less and more than the second prescribed amount, and a state that the ink is of the second prescribed amount of less. The first route X and the second route Y may be formed so that the three stages of ink residual amounts correspond to a state that a large amount of ink exists, a state that the ink is in a near-empty state, and a state that the ink is in an ink empty state. This makes it possible to detect a near-empty state and an ink empty state more correctly by judging an ink residual amount in each state more reliably.

The ink cartridge provides the following advantage. In this ink cartridge, the second route Y is longer than the first route X. The electrical characteristic between the pair of electrodes varies depending on the length of the route that establishes electrical continuity between the electrodes 51, 52. Therefore, the difference between electrical characteristics between the pair of electrodes 51, 52 can be increased and hence the ink residual amount can be judged more reliably.

The ink cartridge provides the following advantage. A barrier is further provided which erects from a bottom portion of the ink cartridge and is disposed between the pair of electrodes 51, 52. The first route X is formed so as to go over the top end of the barrier in the state that the ink is more than the prescribed amount, and the pair of electrodes 51, 52 are connected to each other by the second route Y at least part of which extends along the barrier in the state that the ink is of the prescribed amount or less. When the amount of ink has decreased and its top surface has become lower than the top end of the barrier, the first route is disconnected reliably and the second route remains as a route that establishes electrical continuity between the electrodes. Therefore, clearly different electrical characteristics occur between the pair of electrodes and hence the ink residual amount can be judged reliably.

The ink cartridge according to the first or third embodiment provides the following advantage. The barrier surrounds one of the pair of electrodes 51, 52 and takes the form of a cylinder having a top opening. Since one electrode is surrounded by the cylindrical barrier, the inside and the outside of the cylindrical barrier are reliably isolated from each other when the amount of ink has decreased and its top surface has become lower than the top end of the cylindrical barrier. Therefore, clearly different electrical characteristics occur between the pair of electrodes 51, 52 and hence the ink residual amount can be judged reliably.

The ink cartridge according to the first or third embodiment provides the following advantages. Part of the second route is defined by a groove 71 that is formed in the side surface of the barrier and a cover member 65 that covers an opening, in the side surface, of the groove, and the groove has, at one end thereof, an opening that is located on the side of one of the pair of electrodes and has, at the other end thereof, an opening that is located on the side of the other electrode. Since ink flows through the groove 71, electrical continuity between the electrodes 51, 52 can be established reliably. Further, since the part of the second route can be defined by covering the groove 71 in the side surface of the barrier with the cover member 65, the difference between electrical characteristics between the pair of electrodes 51, 52 can be increased.

The ink cartridge according to the second embodiment provides the following advantage. The barrier has an opening at a position that is distant, approximately in a horizontal direction, from the line segment connecting the pair of electrodes 51, 52, and a curved line existing approximately in a horizontal plane and connecting the pair of electrodes past the opening is longer than the first route that goes over the top end of the barrier. Since the first route and the second route are different from each other in length, their electrical characteristics between the pair of electrodes are also different. This makes it possible to judge the ink residual amount reliably.

The ink cartridge according to each of the embodiments provides the following advantage. The barrier surrounds at least one of the pair of electrodes 51, 52 and takes the form of a cylinder having a top opening. Since at least one electrode is surrounded by the cylindrical barrier, the inside and the outside of the cylindrical barrier can easily be isolated from each other when the amount of ink has decreased and its top surface has become lower than the top end of the cylindrical barrier. Therefore, more clearly different electrical characteristics occur between the pair of electrodes and hence the ink residual amount can be judged more reliably.

The ink cartridge according to the modified example provides the following advantage. Part of the second route is formed by a fiber member 65*a* made of an ink-permeable fiber. This allows the second route to establish electrical continuity between the electrodes reliably.

The ink cartridge according to the modified example provides the following advantages. Part of the second route is formed by a hollow pipe 165. This allows the second route to establish electrical continuity between the electrodes reliably. Further, since the length of the pipe can be changed arbitrarily, the length of the second route can be changed easily.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. An ink-jet recording apparatus comprising:

a pair of electrodes that are in contact with ink in the ink container and that are spaced apart;

a detecting unit that detects an electrical characteristic between the pair of electrodes;

a first route of least electrical resistance, which is formed so as to electrically connect the pair of electrodes via the ink in a state that the ink in the ink container is more than a first prescribed amount;

a second route of least electrical resistance, which is formed so as to electrically connect the pair of electrodes via the ink in a state that the ink in the ink container is of the first prescribed amount or less, the second route establishing electrical continuity though it is different from the first route in the electrical characteristic between the pair of electrodes via the ink; and a first judging unit that judges an ink residual amount of the container based on the electrical characteristic detected by the detecting unit.

2. The ink-jet recording apparatus according to claim 1, wherein the electrical characteristic between the pair of electrodes is further different in a state that the ink in the ink container is of a second prescribed amount or less, the second prescribed amount being smaller than the first prescribed amount.

3. The ink-jet recording apparatus according to claim 2, further comprising:

a consumed ink obtaining unit that sequentially obtains a cumulative consumption amount of the ink;

a second judging unit that judges the ink residual amount on the basis of the obtained consumption amount; and a controller that performs a display operation when the residual ink amount judged by the first judging unit becomes the second prescribed amount or less and the residual ink amount judged by the second judging unit becomes the second prescribed amount or less.

4. The ink-jet recording apparatus according to claim 3, wherein the consumed ink obtaining unit starts to sequentially obtain the cumulative consumption amount of the ink when the residual ink amount judged by the first judging unit becomes the first prescribed amount or less; and the controller performs the display operation to indicate ink-empty when the residual ink amount judged by the first judging unit becomes the second prescribed amount or less and the residual ink amount judged by the second judging unit becomes the second prescribed amount or less.

5. The ink-jet recording apparatus according to claim 1, wherein the second route is longer than the first route.

6. The ink-jet recording apparatus according to claim 5, further comprising:

a barrier that erects from a bottom portion of the ink container and is disposed between the pair of electrodes;

wherein the first route is formed so as to go over a top end of the barrier in the state that the ink is more than the first prescribed amount, and the pair of electrodes are connected to each other by the second route at least part of which extends along the barrier in the state that the ink is of the first prescribed amount or less.

7. The ink-jet recording apparatus according to claim 6, wherein the barrier surrounds one of the pair of electrodes and is a cylindrical form having a top opening.

8. The ink-jet recording apparatus according to claim 6, wherein the part of the second route is defined by a groove that is formed in a side surface of the barrier and a cover member that covers an opening of the groove extending along the side surface; and wherein the groove opens at one end thereof to one of the pair of electrodes and opens at the other end thereof to the other of the pair of electrodes.

9. The ink-jet recording apparatus according to claim 6, wherein the barrier has an opening at a position that is distant, approximately in a horizontal direction, from a line segment connecting the pair of electrodes, and the second route that connects the pair of electrodes through the opening is longer than the first route that goes over the top end of the barrier.

10. The ink-jet recording apparatus according to claim 9, wherein the barrier surrounds at least one of the pair of electrodes and is a cylindrical form having a top opening.

11. The ink-jet recording apparatus according to claim 9, wherein the barrier comprises a plurality of barrier members erecting from the bottom portion of the ink container, the plurality of barrier members arranged substantially in parallel to each other between the pair of electrodes in such a manner that the second route extends between each two of the barrier members that are adjacent to each other.

12. The ink-jet recording apparatus according to claim 1, wherein the ink container is an ink cartridge that is configured to be selectively detached from the ink-jet recording apparatus.

13. The ink-jet recording apparatus according to claim 1, wherein the first judging unit judges a near-empty state and an ink empty state using the pair of electrodes and the detecting unit.

14. The ink-jet recording apparatus according to claim 13, wherein the first judging unit judges the near-empty state when a resistance between the pair of electrodes exceeds a first value and judges the empty state when the resistance between the pair of electrodes exceeds a second value that is greater than the first value.

15. An ink cartridge for storing ink, comprising:

electrode insertion portions through which a pair of electrodes are inserted so as to come into contact with ink in the ink cartridge;

a first route of least electrical resistance, which is formed so as to electrically connect, via the ink, the pair of electrodes inserted through the electrode insertion portions in a state that the ink in the ink cartridge is more than a prescribed amount; and a second route of least electrical resistance, which is formed so a electrically connect the pair of electrodes via the ink in a state that the ink in the ink cartridge is of the prescribed amount or less, the second route establishing electrical continuity though it is different from the first route in an electrical characteristic between the pair of electrodes via the ink.

16. The ink cartridge according to claim 15, wherein the electrical characteristic between the pair of electrodes is further different in a state that the ink in the ink cartridge is of a second prescribed amount or less, the second prescribed amount being smaller than the prescribed amount.

17. The ink cartridge according to claim 15, wherein the second route is longer than the first route.

18. The ink cartridge according to claim 15, further comprising:

a barrier that erects from a bottom portion of the ink cartridge and between the pair of electrodes;

wherein the first route is formed so as to go over a top end of the barrier in the state that the ink is more than the prescribed amount, and the pair of electrodes are connected to each other by the second route at least part of which extends along the barrier in the state that the ink is of the prescribed amount or less.

19. The ink cartridge according to claim 18, wherein the barrier surrounds one of the pair of electrodes and is a cylindrical form having a top opening.

20. The ink cartridge according to claim 18, wherein the part of the second route is defined by a groove that is formed in a side surface of the barrier and a cover member that covers an opening of the groove extending along the side surface; and wherein the groove opens at one end thereof to one of the pair of and opens at the other end thereof to the other of the pair of electrodes.

21. The ink cartridge according to claim 18, wherein the barrier has an opening at a position that is distant, approximately in a horizontal direction, from a line segment connecting the pair of electrodes, and the second route that connects the pair of electrodes through the opening is longer than the first route that goes over the top end of the barrier.

22. The ink cartridge according to claim 21, wherein the baffler surrounds at least one of the pair of electrodes and is a cylindrical form having a top opening.

23. The ink cartridge according to claim 21, wherein the baffler comprises a plurality of barrier members erecting from the bottom portion of the ink container, the plurality of baffler members arranged substantially in parallel to each other between the pair of electrodes in such a manner that the second route extends between each two of the baffler members that are adjacent to each other.

24. The ink cartridge according to claim 15, wherein part of the second route is formed by a fiber member made of an ink-permeable fiber.

25. The ink cartridge according to claim 15, wherein part of the second route is formed by a hollow pipe.

26. An ink cartridge for storing ink, comprising:

a pair of electrodes that are disposed so as to be in contact with ink cartridge;

a first route of least electrical resistance, which is formed so as to electrically connect the pair of electrodes via the ink in a state that the ink in the ink cartridge is more than a prescribed amount; and a second route of least electrical resistance, which is formed so as to electrically connect the pair of electrodes in a state that the ink in the ink cartridge is of the prescribed amount or less, the second route establishing electrical continuity though it is different from the first route in an electrical characteristic between the pair of electrodes via the ink.

* * * * *